US006220194B1

(12) United States Patent
Kjersem

(10) Patent No.: US 6,220,194 B1
(45) Date of Patent: Apr. 24, 2001

(54) HULL CONSTRUCTION

(75) Inventor: Geir Kjersem, Bønes (NO)

(73) Assignee: LMG Marin AS, Bergen (NO)

( * ) Notice: Subject to any disclaimer, the term of this patent is extended or adjusted under 35 U.S.C. 154(b) by 0 days.

(21) Appl. No.: 09/341,203

(22) PCT Filed: Jan. 7, 1998

(86) PCT No.: PCT/NO98/00003

§ 371 Date: Sep. 7, 1999

§ 102(e) Date: Sep. 7, 1999

(87) PCT Pub. No.: WO98/30439

PCT Pub. Date: Jul. 16, 1998

(30) Foreign Application Priority Data

Jan. 7, 1997 (NO) ..... 970044

(51) Int. Cl.[7] ..... B63B 9/08
(52) U.S. Cl. ..... 114/121; 114/65 R; 166/345
(58) Field of Search ..... 114/65 R, 122, 114/125; 166/345, 355

(56) References Cited

U.S. PATENT DOCUMENTS 4,232,623 * 11/1980 Chou et al. ..... 114/125
4,617,998 * 10/1986 Langner ..... 166/345

* cited by examiner

*Primary Examiner*—Jesus D. Sotelo
(74) *Attorney, Agent, or Firm*—Francis C. Hand, Esq.; Carella, Byrne, Bain, Gilfillan, Cecchi, Stewart & Olstein

(57) ABSTRACT

The present invention relates to a hull construction for a vessel, especially a drilling and/or production vessel for hydrocarbons. The invention also relates to the application of the hull construction according to the invention.

The invention is especially related to designing hulls for single hull ships which are provided for carrying our operations at sea, and especially vessels which are used for drilling petroleum wells, and for intervention and maintenance of this type of well. With the invention, the aim is to provide a hull shape for a vessel which makes the vessel especially well suited for realising these types of well operations in deeper waters and at sea, and so that the vessel can be operative even under difficult weather conditions which are created by waves, ocean currents and winds. The hull design according to the invention will also be well suited for ships which are employed for other current purposes where it is important to control movements of the ship in waves, by way of example in production ships for hydrocarbons, and in ships which carry out seismic investigations of formations beneath the sea bottom.

Drilling after oil and gas at sea is carried out either with floating drilling vessels or devices fastened to the bottom The known floating types of vessel can either be half submergible drilling rigs, which are also called 'semisubs', or can comprise drilling ships for this type of operation.

24 Claims, 5 Drawing Sheets

HULL CONSTRUCTION

Half submergible drilling rigs have had extended application in rough weather regions at sea because this type of rig has an especially favourable response to movement relative to waves. By favourable movements of the vessel is meant that the swings, that is to say the amplitudes, during heaving, rolling and pitching are relatively small in large waves It is very advantageous to obtain movements of small amplitude because smaller demands can then be placed on the drilling equipment on board the rigs.

At the same time the response cycle is long that is to say usually 15–16 seconds or more. For a ship which moves up and down in the waves its response cycle is defined as the time elapsed from a maximum and back to the same maximum. Long response cycles are favourable for the equipment which stands on board the drilling vessel because the accelerations in the movements thereby become moderate, something which also places fewer demands on the equipment on board the rig. As regards response cycles reference is made to the enclosed diagram where the movement characteristics of different vessel constructions are compared during the different wave cycles occurring.

The favourable movements for half submergible rigs is due to these types of floating drilling devices consisting of a series of vertical columns which break the water line, at the same time as the columns are structurally bound together by the deck of the device and by horizontal pontoons beneath the surface of the water. In this way, the water line area of half submergible platforms becoming less relative to the total buoyancy volume, is achieved since the largest portion of the forces from waves arises in the water line area, and diminishes downwards with depth, the wave forces are reduced on these types of devices. In addition, the horizontal pontoons have a favourable effect on the vertical heaving movements of the rig (the semisub) because they function primarily as a brake in the vertical direction when the surrounding mass of water becomes broken up and thus provide a theoretical additional mass to the rig.

Besides it shall be observed that by the natural water line of the hull, is meant the natural water line when the hull is finally completed with fittings, machinery etc. for a vessel, such as a drilling ship or the like.

For all types of floating drilling vessels it is the vertical heaving movements which are especially critical, This is due to the vessels having, during the operations a drill stem made of pipe which hangs in the drilling rig of the vessel and extends down through the well. This stem is rigid, and in order to ensure that movements of the drill stem down through the well are unaffected by movements of the vessel, the vessel is in addition furnished with special arrangements which can compensate for movements of the ship. These arrangements have however limitations both as regards movements, accelerations and maximum swings, and this involves a need to minimalise stresses on this equipment by accurately controlling the hull design of the vessel.

In spite of its good movement characteristics half submergible rigs clearly have disadvantages as regards the carrying out of cost-effective drilling operations A disadvantage is for example that the hull becomes very expensive to build since it is composed of columns, pontoons, struts and decks. In addition, such half submergible rigs are especially sensitive to displacements of center of gravity, for example on shifting deck cargo. The biggest disadvantage is however that the total payload which can be taken on board is limited when the stability of the rig is taken into account.

This entails a half submergible rig being dependent upon continuous supplies of consumption material during the drilling operation. This is carried out normally by supply vessels which are made specially for this purpose. This is however very expensive to carry out, because as a rule it requires a vessel having to be available for the rig the whole time.

In addition, when the drilling operations shall take place far out at sea, and possibly with substantial distances from the closest situated supply base, this involves a significant increase in costs. In addition, deep and long wells require extra feedings of supplies which contributes to increasing further expenses. It the supply lines are particularly long, there can be a need for an extra supply ship in the continuous operation. The earliest half submergible rigs had a payload capacity of about 2,000 tons, while a modern halt submergible rig to-day ought to have a payload capacity of over 4,000 tons. A half submergible rig is usually anchored during the drilling operations at sea, and at the same time there are often laid out 8–10 anchors.

In addition to half submergible rigs, drilling ships are also used as floating drilling vessels at sea. These have the advantage that they can take considerably larger cargoes on board. A drilling ship can often take on board all the payload before it puts to sea in order to drill the well. This makes the drilling ship nearly independent of assistance from supply ships. While a half submergible rig is dependent on tugs when it shall be transferred from the one well to another, a ship can transfer itself with its own propulsion machinery. In those regions where it is far to the nearest supply base, such as for example in the Far East where oil is searched for at sea several days journey from the supply base, such drilling ships have found a broad application.

However drilling ships have clear limitations in their field of application. The known drilling ships are produced as conventional vessels with a single hull. This entails their being very sensitive to larger waves since they have a less favourable movement response compared to usual half submergible rigs. These poor dynamic ocean characteristics for drilling has meant that drilling ships, in spite of their excellent load capacity, cannot be used in more inhospitable regions such as the North Sea and the Atlantic Ocean. Drilling ships have however great prevalence and application in more hospitable regions, where the waves are relatively small such as in sea locations outside Brazil, Indonesia and the like.

A drilling ship will have a relatively large water line area compared with half submergible rigs and is therefore more exposed to wave forces than such rigs. While an anchored rig is nearly uninfluenced by the direction environmental forces come from, a drilling ship is dependent on being able to rotate with the weather the whole time so as to be able to minimalise the forces the ship is exposed to. This is brought about by the drilling ship being equipped with a data-controlled automatic positioning system which guarantees the position relative the well and to the direction of the wind, waves and currents.

The most significant drawback with the known drilling ships is that they are sensitive to the vertical heaving movements which are generated by waves, both as regard amplitude and cycle. Known drilling ships have a length of 160–80 m and a typical breadth of 22–25 m. All of these types of ship have largely parallel ship's sides and have a normal heaving cycle of 7–8 seconds. This places moderate demands on the equipment so long as the heaving swings are moderate. A normal maximum heave for a drilling ship is 7 m (that is to say 2×the amplitude), and this can be theoretically handled by known compensator systems.

However this is wholly insufficient for more rough weather regions, where this type of ship can easily get heaving movements of 8–10 m depending upon wave heights and weather conditions. The theoretically simplest manner to solve this problem could be to widen the extreme values of the compensator system of the drilling ship, but with such a short cycle this will means large accelerations of the equipment with consequent forces and stresses which can both lead to breakage and fatigue.

Another theoretical way to solve this problem can be to increase the size of the ship, possibly in combination with increasing the capacity of the compensator system. For example a ship having a length of 300 m, 40 m breadth and 25 m height, can move with small amplitudes and have long cycles of movement, plus it can have a significant load capacity. Thus such a vessel would theoretically be able to combine the movement characteristics of the half submergible rig and the load capacity of the drilling ship. However this is a very expensive and unpractical solution because the investment becomes very high, plus the necessary engine power which has to be installed to maintain the position over the well of a field will be very large and fuel expenses correspondingly high. In addition a ship of this type would be very difficult to transfer and in practice be cumbersome to place at supply bases where the possibility exists of taking provisions on board for the next operative cycle.

In order to be able to carry out drilling operations reliably and effectively it is particularly necessary that the ship's own cycle of heaving is increased, at the same time as the heaving movement becomes as low as possible. Movements of the ship in roll and to some degree in pitch also mean something, but are less critical. It is known that the shape of a single hull vessel will have an influence on the heaving response of the ship, both as regards cycle and amplitude. Thus there is described in Japanese Patent Publication 57056584 a design of hull which will be able to reduce a pitching movement of a single hull ship. The shape of the hull described indicates a longitudinal bulge or lip of the hull of the ship below the water line. This can also increase the ship's own heaving cycle. Other patent specifications specify variants of lips below the water line, such as NO Patent No. 4.829, U.S. Pat. No. 2.327.660 and U.S. Pat. No. 4.372.240. Basin trials have confirmed that a longitudinal lip below the water line of the ship can have a positive effect on the pattern of movement of the ship for a large part of the spectrum of the wave, both with a view to cycle and amplitude. However the basin trials have also shown that for a small portion of the wave spectrum, the heaving movement will be able to be powerfully reinforced if the lip was present alone. A resonance arose around the ship's own natural heaving cycle, so that the amplitude (half of the maximum swing) in this cycle region actually became larger with lips than without. For a drilling ship, this as regards safety is totally unacceptable. In practice, this means that in many instances such lips alone are unsuitable for use on a drilling ship.

In U.S. Pat. No. 3,366,404 different hull designs are indicated with lips, in combination with water which flows in and out of partially closed spaces in the hull of the ship. The partially closed spaces are arranged in external sides of the ship. The patent points out the theoretical background that water which flows in this way will be able to have a positive effect on movements of a ship in heavy seas. The proposed, practical design of a single hull ship (FIG. 6 in the patent) can possibly be taken advantage of in a passenger ship or commercial ship, but is however completely unsuitable for use on a drilling ship. This is due to the fact that the proposed double spaces will occupy very much of the utility volume of the ship. This can be compensated for to some degree by making the ship larger, but this is an expensive solution. However the biggest problem is that modern ships for use in drilling and for the storage of crude oil will require a sealed double hull. Double hulls are protection against contamination on collisions and running aground. This is not possible with the proposed solution without establishing a third, sealed inner hull. This increases however the weight of steel and the expense of the ship still further, something which finally is detrimental to the payload of the ship.

It has also been found that such spaces have other unfortunate side effects. Even if the inward/outward flow of the water dampens the heaving movements the waves provide very large push and pull stresses on the hull. Corresponding conditions will apply to the pontoon which is shown in GB-2.008.515. The divided side surfaces will entail large horizontally directed pull forces and side movements. Corresponding applies to the known EKOFISK—tank in the North sea and which has such a construction.

That external hollow spaces in the side of the hull, which water can flow into and out of via perforations, influence in an unfavourable manner the pattern of movement in waves of a floating construction, is a contention which factually is directly confirmed by FIG. 4 of GB-patent publication 2.257.664. FIG. 4 of the patent shows clearly the effect of perforations externally on the pontoon parts of a half submergible construction. The three curves represent as follows:

curve 30: water sealed pontoon.

curve 31: 10% perforations curve 32: 20% perforations curve 33: 30% perforations The Figure shows that for the most frequently occurring wave cycle—range of 7–13 seconds, which will also apply to the North Sea, perforations in the outer hull of the pontoons would entail a worsening of the response of the platform compared to an unperforated pontoon, with respect to increasing wave cycles. In addition, this response increases with the percentage degree of perforations, 30% perforations giving a larger response than 10% perforations. According to FIG. 4 the improvements (in relation to curve 30 unperforated) with perforations show first when the cycle exceeds about 16 seconds and then at first the highest perforation number gives the best and lowest response. But despite the perforations all three curves lie over 1.0 in response, that is to say that in the whole wave cycle—range over 14 seconds the platforms will heave more than the wave height, and with a factor of up to 1.15–1.35.

This means that it is unfavourable to arrange hollow spaces which are accessible via perforations in external hull parts which are influenced by waves, and in addition it provides strong horizontal pulls of the vessel.

In U.S. Pat. No. 3,386,404 there are also indicated possible solutions for use of the principle on semi-subs (FIG. 7) and on double hull vessels (FIG. 8). For semi-subs the solution has little attraction because of the increased weight of steel on an already weight-sensitive vessel. Double hull vessels are little suited to operate in rough seas because it has been found that larger waves can rise up in the deck between the hulls, something which can produce large stresses in the whole hull construction. The proposed solution of dampening the heaving movements on a double hull vessel can thus worsen the situation in that the waves rise up still more readily in the underside of the deck.

The use of open ship's wells in the ship (Eng. moonpool) is well-known, and is employed inter alia in the transportation of living fish and in a series of offshore vessels which are to lift tools and equipment down onto and upwardly from the sea bottom. The equipment, such as remote controlled crafts, maintenance implements, etc. can be easily lifted in this manner from the deck, through the well and downwardly towards the sea bottom. A typical, larger well for an inspection vessel for the North Sea has a horizontal hull opening from 3×5 m. and up to 7×7 m. 7×7 m. is also a size typical of the drilling ships constructed hitherto. Here shall be mentioned the solution which is known from DE-patent publication 25 26 609. Here the object of the well is however nor to be able to influence movements of the ship in the sea. Instead it is specified that the well has as a function to make possible operations under water in a protected manner against the impact of waves, for example for submerging equipment on the sea bottom. Besides it is known that the heaving movements of a construction in waves is a direct function of its water line area.

Newer drilling ships, which have now been planned for hospitable waters like the Gulf of Mexico, and which have a length of over 220 m., are planned with ship's well openings of 10×10 m. for conventional well operations. This is done so that one shall be in a position to lower large well frames down onto the sea bottom and other heavy and large equipment through the well of the ship. If the ship is to be very advanced and shall be able to operate with two pipe strings at the same time, ship wells have been indicated of up to 10×20 m. The said planned drilling ships for the Gulf of Mexico have a length of about 220 m. and a breadth of about 40 m. The water line area on these ships is about 8000 $m^2$. A maximum ship's well of 200 $m^2$ will thus constitute about 2.5% of the total water line area. On smaller drilling ships, with for example a length of 180 m., water line breadth of 35 m., and water line area of 6000 $m^2$, a ship's well which for operative reasons has a well water line area of 200 $m^2$, will constitute 3.3% of the entire water line area.

It is an object of the present invention to provide a hull design for a single hull vessel, especially for drilling and production ships, where the aforementioned drawbacks connected with the movements of the ship can be wholly or partially eliminated.

It has now been found that a modification of the design and dimensioning of these wells can have great significance in order to be able to control the heaving movements of a drilling ship.

Briefly, the invention provides a hull construction for a vessel which is comprised of a deck, a keel below the deck, at least one well at a mid-section of the deck extending vertically from and between the deck and the keel for an inward and outward flow of sea water from below and at least one inwardly projecting lip in the well forming a constricted opening in the well to delay the inward and outward flow of sea water in the well in order to improve the inertial resistance of the hull against heaving motions.

According to the present invention the hull construction is applied to ships, especially ships for drilling after and/or production of oil and gas, or for seismic investigations, where movements of the vessel, especially heaving movements, as a consequence of heavy seas, must be cushioned.

The hull construction according to the invention will be explained further in the following description having regard to the accompanying Figures, in which.

Figure 6:
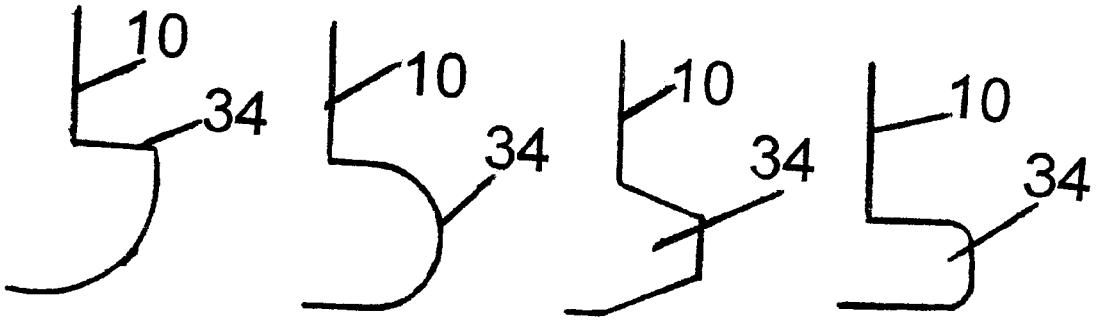

The FIG. 6 show cross-sections of 4 different designs of a lip.

Figure 7:
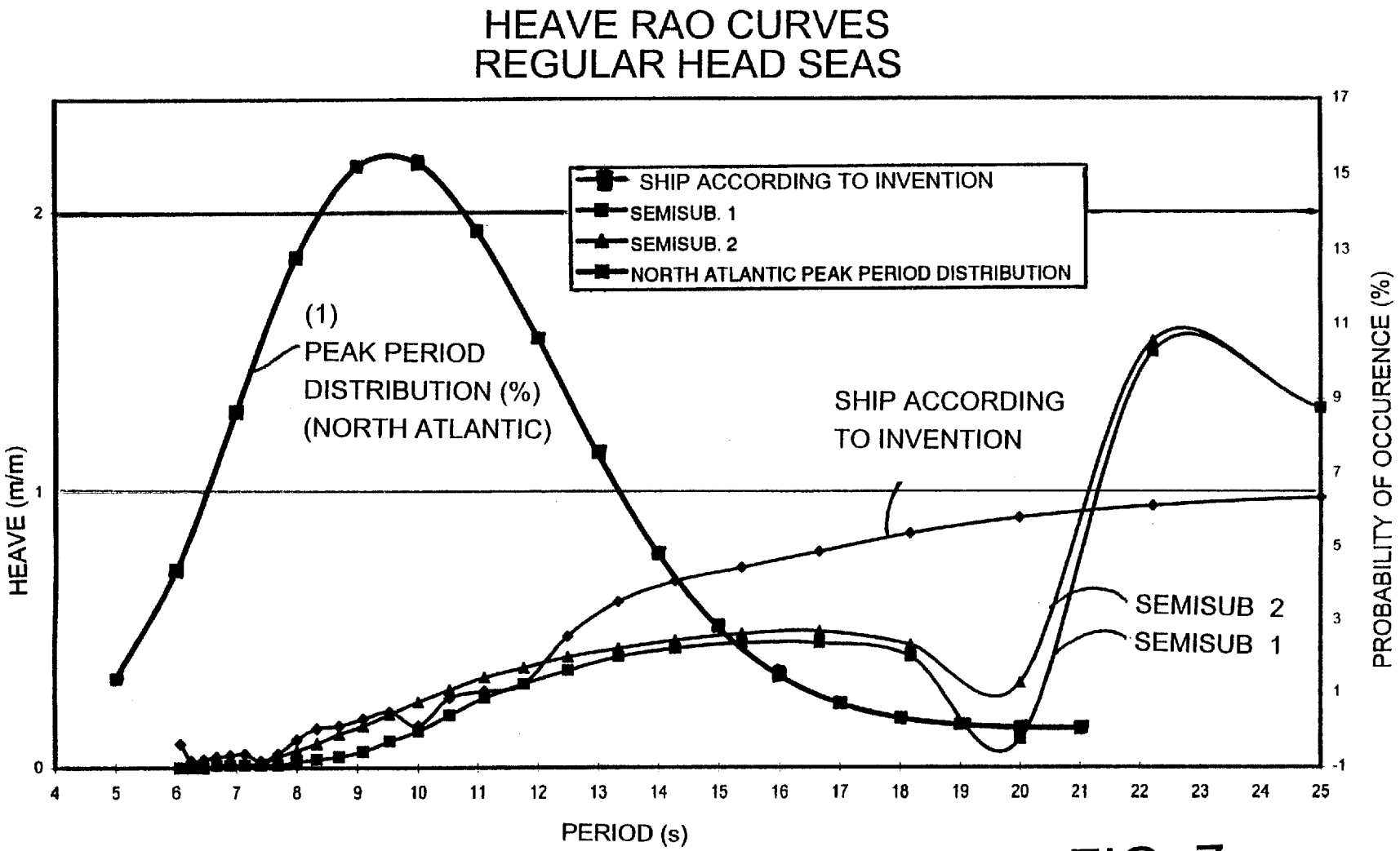

FIG. 7 shows a graphical representation of the relationship (HEAVE) between the heaving movements and wave height of different types of vessel (single hull as according to the invention and two half submergible platforms of dissimilar size) as a function of the wave cycle. The curves are of the same type as are shown in the afore-mentioned GB-2 257 664.

Like parts of the hull designs are given the same reference numerals on the different Figures.

Figure 1:
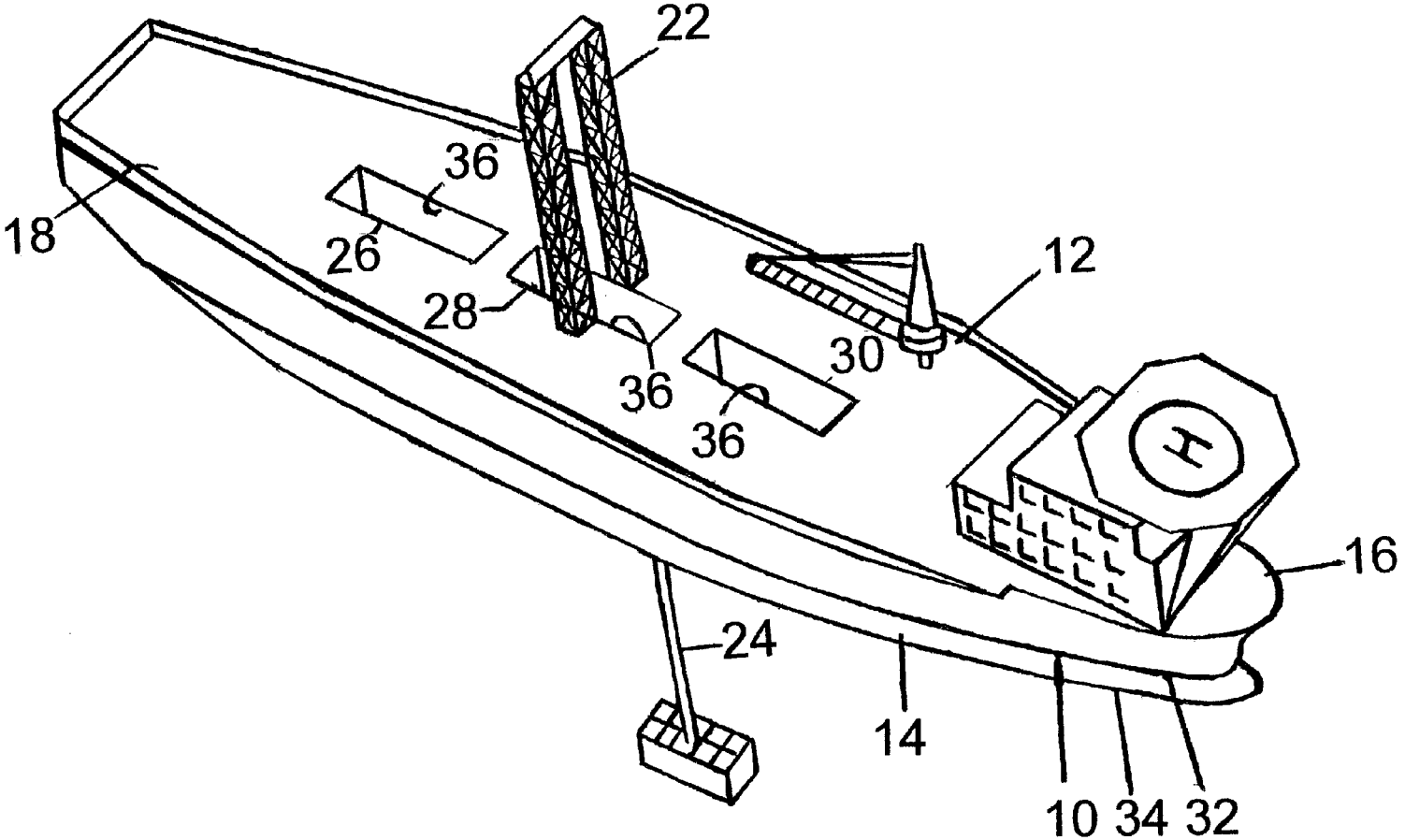
FIGS. 1 and 2 show an embodiment of a drilling ship in perspective and in side section respectively, designed on the basis of the hull construction according to the invention.
Figure 2:
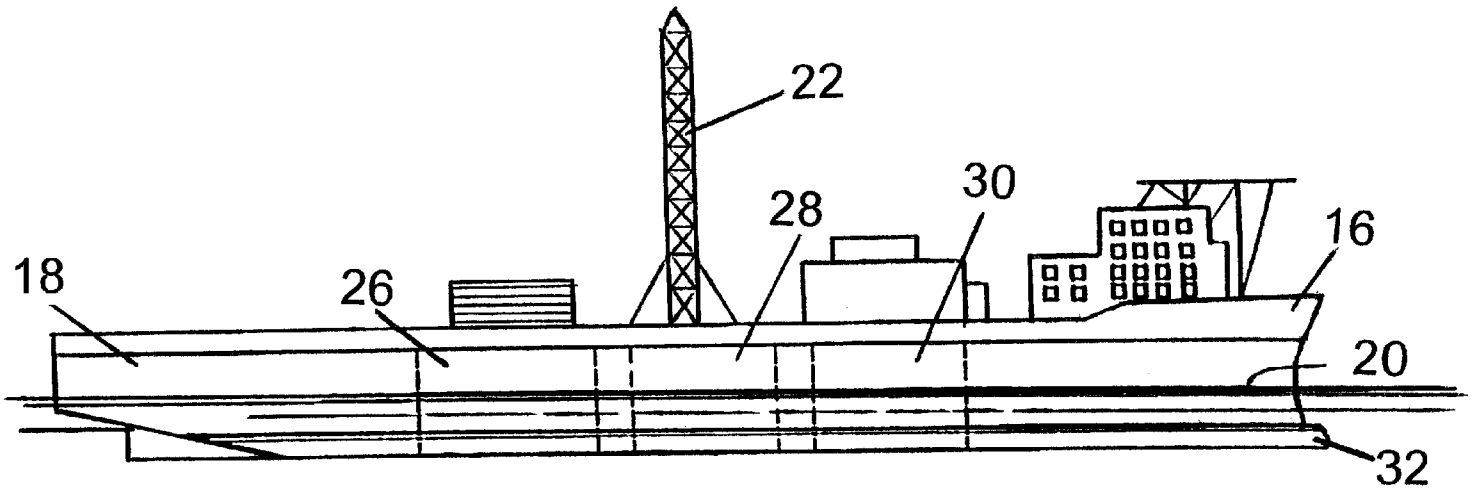

By way of introduction reference is made to FIGS. 1 and 2, which show a perspective view and a side section respectively of a drilling ship which is built designed on the basis of the hull construction 10 according to the invention.

FIGS. 1 and 2 show a drilling ship having a hull 10 with an amidships side portion 12, keel portion 14 and a bow portion 16 and a stern portion 16. The amidships side portion 12 of the hull has largely perpendicular ship's sides. FIGS. 1 and 2 show a drilling ship with a derrick 22 from which an oil/gas well, which leads down into the sea bottom 23, is drilled or is operated by means of a drill stem 24 or like equipment. The stem 24 extends from the derrick 22 of the ship downwardly through a vertically extending well 28, open upwards and downwards in the ship. In addition to the well 28, the ship comprises two further similar wells 26,30 (astern and front respectively). All these wells 26,28,30 are dimensioned as explained above, in order to give the ship the desired movement characteristics in the sea.

Figure 3:
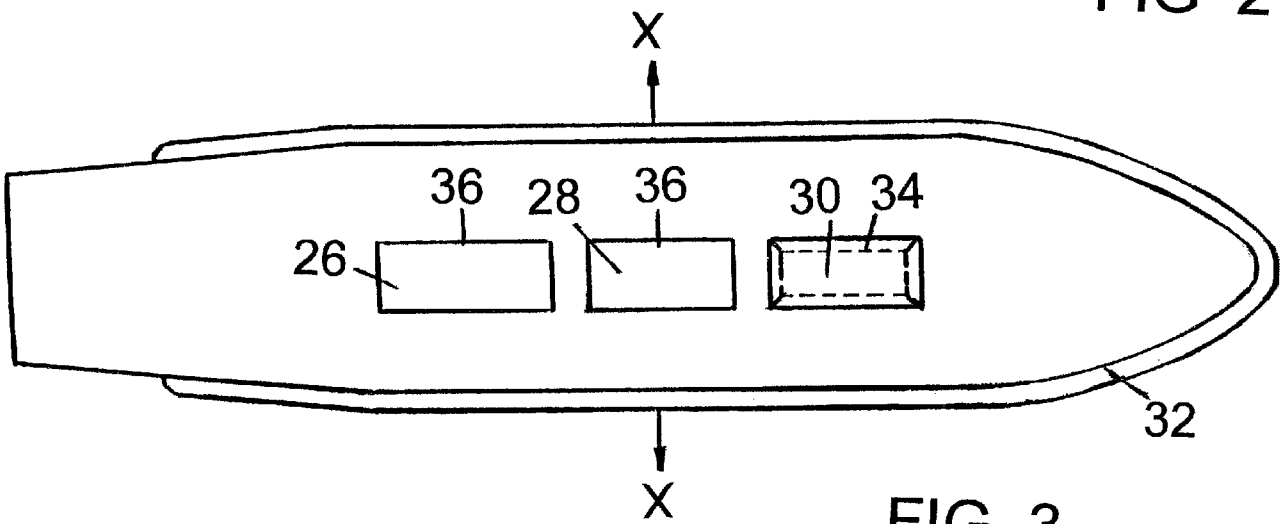
FIG. 3 shows a plan view of the hull construction according to FIGS. 1 and 2.

According to the invention, the hull of the ship comprises one or more wells 26,28,30 in order to influence the heaving movements of the ship in a favourable manner. The wells are open, that is to say they extend continuously from an upper deck vertically through the whole ship and outlet into the sea in the keel. When the ship begins to move in the waves, the water level in each well begins to fluctuate upwards and downwards like a vertically movable (standing) water column, in relation to the level of the water line. The water will stand a distance upwards in the well and in a stationary condition is adjusted to a normal level which is called the water line level, and such is most clearly evident by reference numeral 20 in FIG. 4. There are several alternatives for the number and placing of the wells. According to one solution, and which is shown in FIGS. 1–3 the ship is equipped with three wells with largely rectangular plan sections, and which extend lengthwise along the longitudinal axis of the ship. A distribution or arrangement of the wells, that is to say the well area, along the mid-section of the ship has been found to be favourable. The preferred number of wells as well as their length and breadth dimensions are evident from the following. Alternatively the ship can comprise a single longitudinal well, and which can have the same water line area (see below) as the three wells 26,28 and 30 together. To start with, the wells are designed with smooth and largely perpendicular well walls 36. Desirable installations on the sea bottom 23 can be operated from a deck of the ship via these wells.

As an alternative to wells with rectangular or square cross-sections they can also be designed with other cross-sectional forms such as oval, circular or other more irregular shapes. The precise cross-sectional form will be able to be varied all according to the actual hull construction, in order for example to pay regard to the necessary frame construction.

Figure 4:
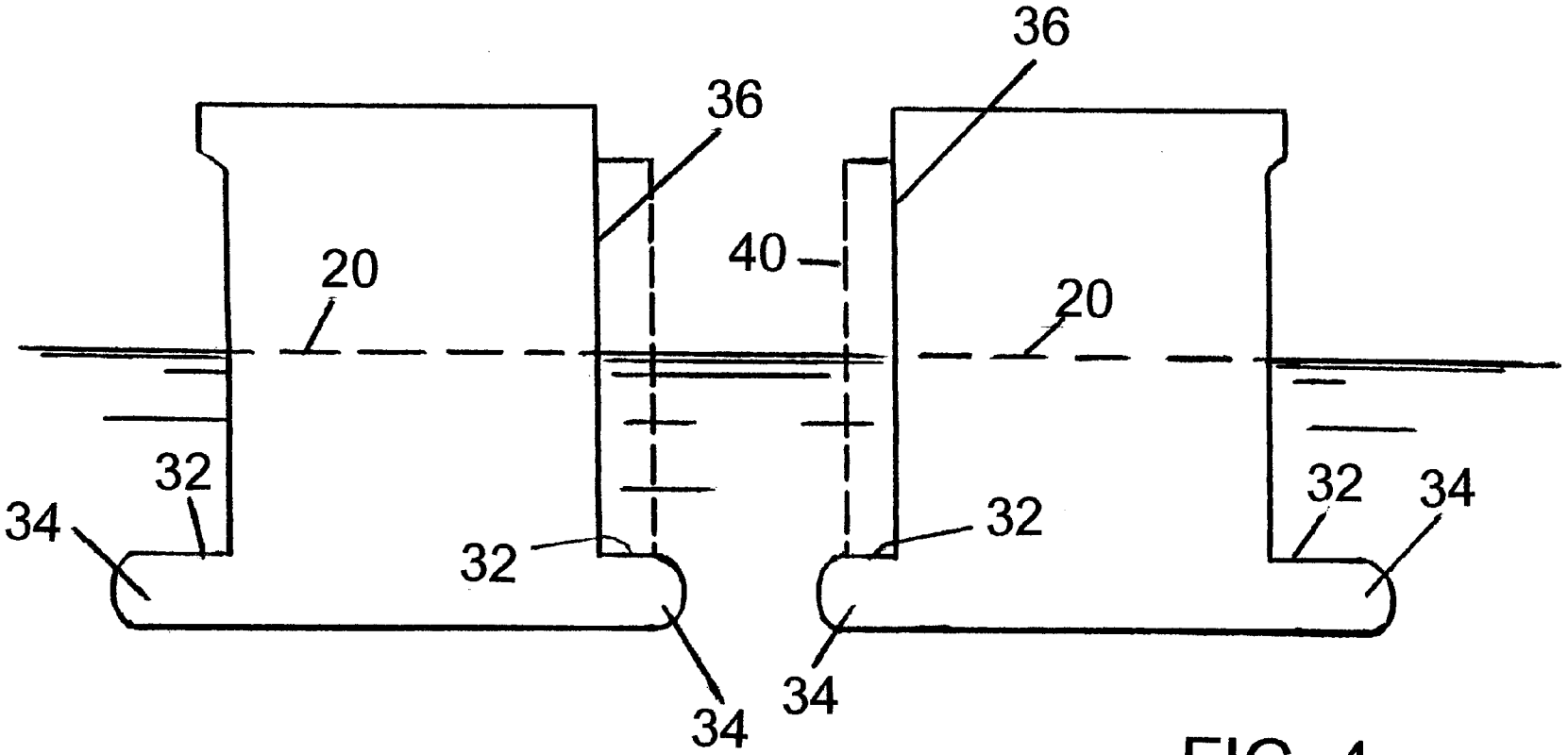
FIG. 4 shows a cross-section of the hull construction taken along the line X—X of FIG. 3.

The normal water line of the ship is illustrated in FIGS. 2 and 4 by the reference numeral 20. The area (cross-sectional area) which the ship covers in a horizontal plane through the water line of the ship, is defined as the water line area of the ship. How large the well or the wells ought to be is considered close to how large a water line area the well(s) will cover in relation to the water line area of the ship. It has been found that in order to provide an effect of significance the water line area of the well of the ship ought to exceed about 8% of the total water line area of the ship. At the same time the water line area in the well ought not to exceed about 30% with a thought of the capacity of the ship for taking on board payload in relation to the total dimensions of the ship. A water line area in the well of the ship of about 15% is considered to be very favourable.

Figure 5:
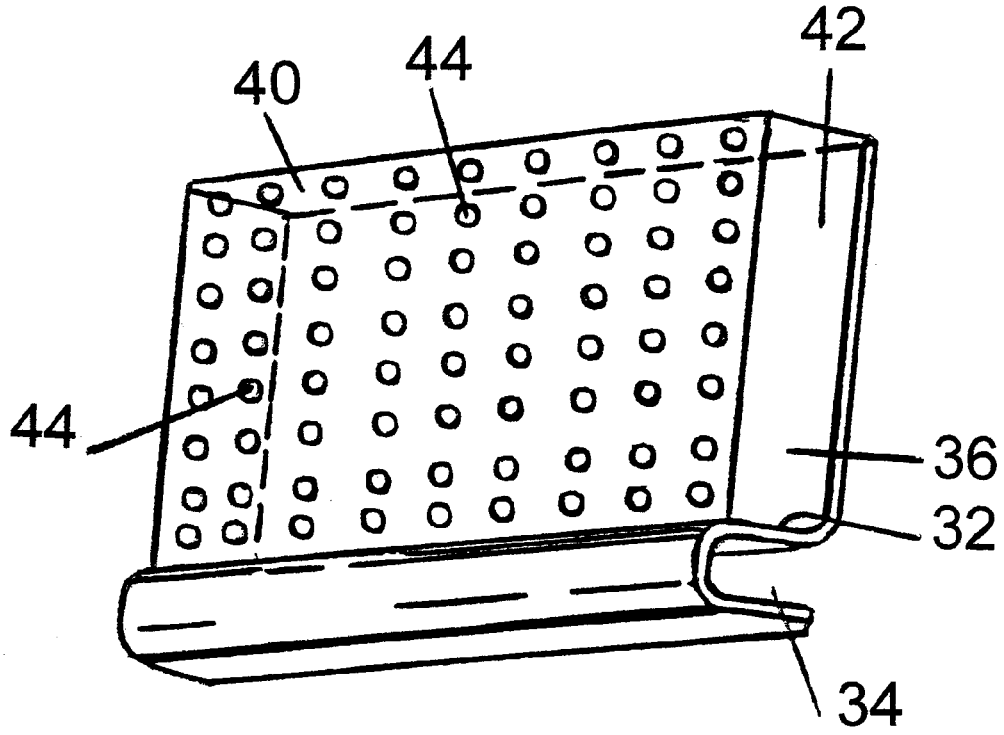
FIG. 5 shows in perspective a section of an especially preferred design of the inner well wall.

When the ship is exposed to waves water will flow into the wells from below when the ship sinks down in a wave, while the water runs out of the well when the wave draws itself down under the ship. According to a preferred construction the portion of the well which comes into contact with the inwardly and outwardly flowing mass of water comprises means which function as to delay or brake the said a inward and outward flow of water from the well, and which thereby can further improve the inertia resistance of the ship against heaving movements. Two such means are shown in FIG. 5, the one involving the lower portion of the well walls 36 comprising an essentially horizontal outwardly projecting shoulder facing out from the well wall 36, with a largely flat upper recess 32, so that there is formed a lip 34. The lip 34 extends largely around the whole inner wall periphery 36 of the well and forms therefore a constricted entrance opening to the well from below. Lowermost in the well wall 36, the lip 34 is shown in phantom in connection with the front well 30 of the ship in FIG. 3.

Instead of the lip extending continuously around the periphery as the FIG. show, it can be divided up into a number of mutually separated outwardly projecting lips/lips or beads These outwardly projecting single lips can also be arranged at different height levels in the well wall 36 of the ship.

According to the invention the well of the shit comprises additional means which can delay the inward and outward flow of water into the well. This can be brought about by arranging along the well walls one or more extra spaces which water can flow into and out of, and which thereby delay the outward and inward flow of the water to the well, and which consequently contributes further to improving the movements of the ship. The space or spaces are formed, with reference to FIGS. 4 and 5, by installing in the well a wall plate 40 parallel to each of the well walls 36 so as to establish a water in/out flowable space 42. The space 42 is defined by the well wall 36, the plate 40, the upper side surface 32 for the well lip 34, and can be open upwards. The plate 40 comprises a number of through-going holes or openings 44. In FIGS. 4 and 5 there is shown a perforated plate 40, that is to say with a series of regular throughgoing holes 44 which connect the space 42 with the well present outside, The plate 40 can alternatively comprise a series of larger holes lowermost against the lip, while the plate further up does not include openings. By means of these devices a portion of the water which penetrates into the well will flow through the holes 44 in the plate 40 and into the space 42 present behind.

In this manner a delay is achieved of the inward and outward flow of water into the well. This causes the cushioning of the ship against heaving movements to become further improved. Besides tests are referred to which are discussed in detail later.

The depth (the distance) from the perforated (44) wall 40 to the sealed well wall/ship's bulkhead (36) existing behind in the tests with a full-scale ship, having a length of 180 m, water line breadth of 35 m, and total water line area of about 6000 $m^2$, can be up to 1.6 m. However a good cushioning effect can be achieved even when the depth behind the wall 40 varies. The depth to the bulkhead 36 present behind, can besides be in the region of 1–5 m..

As is evident form the FIGS. 1–3 the hull has an approximately flat-bottomed keel portion. Along the outer side of the keel there also extends a continuous or divided up lip 32, which can have the same construction as the well lips 32. From the bottom sides the side of the ship extends by way of introduction largely vertically upwards and forms the inwardly facing substantially horizontal shoulder or flat recess 32 for forming the largely horizontal outwardly facing lip 34. The lip 34 extends largely along the whole length of the keel from the how and backwards to the stern portion of the ship. As mentioned above the existence of such a lip, during individual circumstances, produces negative effects on the heaving movement characteristics of the ship, and such a lip is therefore not obligatory according to the present invention. However it can be preferred in combination with one or more wells of the ship since such a combination can yield a synergistic effect The outer lip of the hull according to the invention stretches from the bow portion of the ship and aft to the stern of the ship where the sloping underside of the stern constitutes the natural termination of the extension. Preferably the lip is designed as far down towards the bottom/keel portion of the ship as possible.

Alternative lip cross-sections both for keel lips and well lips 34 are shown in FIG. 6. According to one of these (FIG. 6*a*) the shoulder portion extends in cross-section as a largely horizontal surface outwardly from ship's side portion 12 so as then to extend perpendicularly and further in an arcuate form which then forms a uniform transition to the underlying largely flat keel portion of the vessel. According to another design shown in FIG. 6*b* the lip is provided instead with a rounded-off form, designed in crosssection as a hemispherical form.

A further construction of the lip of the ship is shown in FIG. 6*c*. According to this construction, the lip slopes downwards and outwards from the perpendicular (well) side of the ship, so as then to extend rectilinearly downwards in order then to slope inwards and downwards, and thereafter so as to extend over into the underlying keel portion of the hull. This form is thereby polygonal, and resembles a trapezoid.

According to a further construction according to FIG. 6*d* the lip comprises a straight, largely horizontal upper side, in order to extend rectilinearly perpendicular vertically and further horizontally inwardly and passes over into the keel portion. It is this construction which is shown in the FIGS. 1–5 . As is evident otherwise sharp edges are rounded off.

According to the invention the keel of the hull has a largely flat under side so that vertical movements of the ship in the sea are able to be dampened as thoroughly as possible.

PERFORMANCE OF PRACTICAL TRIALS, ASSESSMENT OF DIMENSIONAL RELATIONSHIPS IN THE HULL DESIGN ACCORDING TO THE INVENTION

Trials in basins have shown that a lip beneath the water line alone on the hull of the ship has a positive effect on the heaving response of the ship for larger portions of the wave spectrum, but has in part a strongly negative effect for a smaller portion of the wave spectrum in that the heaving movement is on the contrary reinforced. In order to compensate for this unexpected, and negative effect from the lip there have been performed comprehensive basin trials where one, based on a given, and dynamically viewed favourable, hull shape with bulging below the water line the effect of different ship's wells, have been tested, The ship's wells were varied both in size, design and placement The results showed that when the water line area of the wells were increased, the negative resonance effect in heaving gradually went away. In addition an increasing water line area in the wells of the ship. contributed to a further dampening of the heaving movement and an extension of the heaving cycle of the ship.

During basin trials, a hull model was tested based on a ship with a length of 180 m, water line breadth of 35 m, and total water line area of about 6000 $m^2$, as well as comprising a lip beneath the water line of 2.5 m. projecting horizontally outwards which extends from the bow of the ship to almost completely astern. The trials showed by way of example that the given lip in combination with a ship's well area of 900 $m^2$, or about 15% of the total water line area of the ship, would be able to provide a dampening of the maximum heaving movement of fully 60% at a significant wave height H(s) of 3 m., and about 45% at H(s)=5 m. At the same time the natural intrinsic cycle of heaving of the ship was increased by 2.5 seconds. At H(s)=7 m. the effect of lip and a large well area of the ship was reduced to about 20%.

The condition of the sea in the northern portion of the North Sea is H(s)>5 m. for 95% of the year. It is under these conditions a drilling ship shall operate, and then the dampening of the movements of the ship is substantial. At extreme conditions at H(s)>5 m., with maximum waves over 9–10 m., it is to be expected that a drilling ship will to a large degree lie inoperative and await better weather conditions. This is due to the fact that high seas are followed as a rule by strong winds, something which however causes cranes and lifting equipment not to be.

For the response of the ship to the influence of waves, the distribution of the well area along the mid-section of the ship has proved to be favourable. At the same time, this yielded possibilities for retaining the fore-and-aft strength of the ship-hull, in that the well region can be placed within an inner beam in the hull of the ship.

A total well area of 976.8 $m^2$, that is to say breadth b=13.2 and length l=about 74 m., placed amidships showed itself to satisfy requirements for necessary operability for the ship in the northern portion of the Norwegian Sea, at the same time as requirements for the strength of the ship, large carrying capacity for variable cargoes, stability and constructional friendliness were maintained.

A further improvement was achieved by dividing a single well up into several smaller mutually separate wells, for example 2 units of b=13.2 m. and l=23.2 plus one unit with b=13.2 m. and l=27.2 m.. Probably this is due to the fact that the well area was spread over a far greater length along the fore-and-aft axis of the ship. With 3 separate wells one achieves being able to build in beams thwartships between the wells, something which improves the total strength of the ship. In addition one will be able to avoid the problem with the formation of larger fore-and-aft waves inside the well area. For the drilling technical operations it is favourable that the ocean conditions within the well of a ship are as calm as possible.

A surprising effect which arises on dividing the area into 3 wells, has proved to be that the two outer wells, that is to say front and rear wells 26,30 cancel to a certain degree the waves within the centre well 28, where one looks for the drilling operations to take place.

By installing lips within the wells beneath the water line, additional dampening of the movements of the ship is obtained. The lips were placed adjacent towards the bottom of the ship, in the same manner as the outer lips on the hull, and were installed as an annular form round all the sides of the well area. In the basin trials, the lips within the well had a full scale breadth in a horizontal direction of about 1.6 m., something which for example gave an aperture opening of 10×24 m. in the center well. A practical horizontal size of the lips within the well is considered to be about 1–5 m.

The center well will be favourable as the well of a ship for drilling operations, while the main function of the remaining wells will be to improve the movement characteristics of the ship, especially with respect to the response cycle.

By installing a largely vertical wall 40 over the lips within the wells, which has a number of holes or openings 44, a delay was achieved in the inward and outward flow of water inside the well, and especially the inward and outward flow of water to the space 42 behind the wall 40. (When each of the walls "is clothed" with such a wall 40, the space 42 thus forms an annular hollow space which surrounds the aperture of the well.) This involves dampening of the ship with heaving becoming further improved. In the trials there was employed a uniformly perforated/holed wall, having circular perforations which constituted about 25% of the wall area. The trials showed that the desired dampening effect can be achieved with different constructions of the wall, where it is estimated that the area of the wall openings/holes 44 ought to be about 10–30% of the combined area of the wall 40.

In the trials the depth from the perforated wall to the sealed ship's bulkhead present behind corresponded in a full scale ship to about 1.6 m, that is to say that the wall 40 was anchored approximately outermost on the upper surface 32 of the lip 34. The dampening effect can be obtained even if the depth behind this wall is varied. A practical depth for the bulkhead present behind, is considered to be in the range between 1–5 meters.

The results from the combined trials gave very favourable movements for the heaving response of the ship, especially in the most important ocean conditions, H(s)<5 m., for drilling operations.

| H (s) Wave | T (p) Wave | H (max) Wave | Max. Heaving Swing | Heaving Swing Reduction |
|---|---|---|---|---|
| 3 m | 9 sec. | 5.8 m. | 0.95 m. | 60% |
| 5 m | 11 sec. | 9.6 m. | 3.2 m. | 45% |
| 7 m | 12.5 sec. | 13.5 m | 6.4 m. | 20% |

Where
H (s) = significant wave height
T (p) = wave cycle in seconds
H (max.) = maximum wave height According to the invention, the ship has on each side of the hull an expansion 32 in a horizontal direction, to an extent of up to 5.5 meters. It has been found that the expansions/lips on each side of the hull in the range of 1.5–5 meters meters have a good dampening effect on the heaving movements for the hull.

For example the largest amidships side-breadth including the expansion/lip can be up to 60 meters, while the breadth on the amidships side 20 of the hull above the expansion can be up to about 50 meters.

It is preferred that the amidships side 20 of the hull has a breadth which constitutes 20–35% of the total length of the hull. That is to say that a hull which has a length of 180 meters can have a amidships side-breadth of up to 63 meters. For such a hull it is preferred that the lips/the expansion on each side is at least 5 meters. According to one construction the ratio is 22%, that is to say for a vessel having a total length of 160 meters the amidships breadth is 35 meters. According to another preferred construction the amidships breadth, for a hull having a length of 180 meters, is about 40 meters, that is to say 25% of the length, and the largest amidships-hull breadth including the expansion is about 50 meters.

For example a hull can have a breadth B1 of 40 meters including the lip on each side (that is to say each lip has a largest horizontal dimension/breadth of 2.5 meters), while the overlying hull portion 12 has a breadth B2 of 35 meters, and where the upper hull portion (with the bulwark) has a breadth of 40 meters. The hull breadth B3 at the bulwark constitutes approximately the same large breadth (40 meters) as the breadth of the vessel including the lip According to the afore-mentioned the hull length can be 100 meters, that is to say that the breadth can be up to 35% of the length.

With a hull design as indicated in this description the drawbacks are eliminated which are described by of introduction in the present specification in connection with the previously known forms of hull for drilling ships.

An objective and characteristic feature in the development of the present invention has been to produce a newly developed, but nevertheless practical and construction friendly design of a single hull with favourable dynamic properties Single hull vessels have namely a series of economic advantages compared with semi-sub drilling rigs. In addition to the operative advantages of being able to take large payloads, having good space on board, storing oil, etc., a drilling ship is much cheaper to construct than a semi-sub drilling rig.

A drilling ship built with a hull according to the principles which are presented in this specification will be able to have a construction price 60–70% of a semi-sub built to the same specifications. This means savings of several 100 million kroner per vessel. This is due to the fact inter alia that a ship is well-known, little tinged by risk and construction friendly. A ship can be built by many workshops which do not desire to take the risk of constructing a complicated semi-sub.

FIG. 7 shows a graphical presentation of the relationship (HEAVE) between heaving movements and wave height for different types of vessel (single hull as according to the invention, and two types of half-submergible platforms, called SEMISUB 1 and SEMISUB 2) as a function of the wave cycle.

Curve 1 shows the percentage-wise distribution of the wave cycles in the North Atlantic on a yearly basis. ( the abscissa is read against the right ordinate). It will be evident that the wave cycle occurring the most often is about 9 seconds, with an occurrence of about 16.9%. Wave cycles in the range of 7–13 seconds are the most occurring. Over 17 seconds the curve evens out and such cycles will only rarely arise.

Along the left ordinate the heaving function of a vessel in meters of vertical movement is read relative to wave height in meters. The horizontal line marks the point where the heaving is the same as the wave height, that is to say HEAVE=1.0.

The designation HEAVE—RAO means "response amplitude operator", a mathematical function which describes movements of the vessel in heaving as a function as incoming waves.

The three other curves in the diagram show the response for a vessel according to the invention, (that is to say a ship with wells, inner lips, spaces including perforations and external lips), and two semi-subs numbered 1 and 2 (half submerged platforms of different size). It will be evident that in cycles of up to 6 seconds the constructions lie almost still (response=0). During the wave cycle-range occurring the most often, that is to say up to 13 seconds, the three curves ascend uniformly, but for the two semi-subs the curve goes down again forward to cycle 20–21, where there again occurs a steep ascent, and the curve passes the response line for HEAVE=1.0. This means that the semi-subs will swing with greater vertical heaving than the wave itself, when the wave cycle exceeds about 21 seconds. Even if such a long wave cycle occurs rarely, it will probably constitute 2–3 days of a year. Compared with this the HEAVERAO value for the hull construction (according to the invention) will thus ascend uniformly the whole time with the wave cycle, but then levels out and will not exceed the 1.0 line.

The advantages which these curves show, are that for a traditional single hull vessel one has been able to obtain response-values (HEAVE) in meters/meters which, over major portions of the wave spectrum, are just as good or better than the responses for the half submergible platforms SEMI-SUBS 1 and 2. The wave cycle-range where the single hull vessel has poorer responses than the SEMI-SUBS 1 and 2, that is to say of about 14–21 seconds, has in return a probability for occurrence, which goes down lower than 3% and down towards 0%, on a yearly basis. See the values for curve 1, (right ordinate).

Such good response values have previously not been possible to achieve for single hull-vessels, because earlier such vessels have not been constructed as according to the invention, namely a combination of the internal through wells, where the wells comprise means for limiting the inward/outward flow of water, plus that there are mounted external lips beneath the water line on the hull.

There are several advantages with the hull construction according to the invention. Applied as drilling and production ships it can tolerate much larger deck loads than a conventional floating platform. It will be cheaper both in construction and in operation, it is more flexible for transfers, it can if necessary be used without being anchored, and the need for supply ships to serve the drilling/production ship is much less than for a platform.

What is claimed is:

1. A hull construction for a vessel comprising a deck;

a keel below said deck;

at least one well at a mid-section of said deck extending vertically from and between said deck and said keel for an inward and outward flow of seawater from below; and at least one inwardly projecting lip in said well forming a constricted opening in said well to delay said inward and outward flow of seawater in said well to improve the inertial resistance of the hull construction against heaving motions.

2. A hull construction as set forth in claim 1 which further comprises at least one perforated plate disposed in spaced relation to said well and extending upwardly from said lip to define a chamber therebetween for an inflow and outflow of seawater.

3. A hull construction as set forth in claim 2 which further comprises at least one outwardly directed lip on an outer side of said keel extending from the bow towards the stern and below the water line thereof.

4. A hull construction as set forth in claim 3 wherein said outwardly directed lip extends a distance in the range of from 1.5 to 5 meters.

5. A hull construction as set forth in claim 3 wherein said keel has a length of about 180 meters and said outwardly directed lip extends a distance of at least 5 meters from said keel.

6. A hull construction as set forth in claim 3 wherein said outwardly projecting lip has a cross-sectional shape including a horizontal portion and a depending arcuate portion.

7. A hull construction as set forth in claim 3 wherein said outwardly projecting lip has a cross-sectional shape selected from the group consisting of a semi-circular shape, a trapezoidal shape, and a rectangular shape.

8. A hull construction as set forth in claim 2 wherein said plate has circular perforations constituting from 10% to 30% of the total area of said plate.

9. A hull construction as set forth in claim 2 wherein said plate has circular perforations constituting 25% of the total area of said plate.

10. A hull construction as set forth in any one of claims 1 to 3 wherein said inwardly projecting lip in said well is continuous and extends peripherally about said well.

11. A hull construction as set forth in any one of claims 1 to 3 having a plurality of said inwardly projecting lips extending in spaced relation to each other peripherally about said well.

12. A hull construction as set forth in claim 11 wherein at least some of said plurality of inwardly projecting lips are vertically spaced from each other.

13. A hull construction as set forth in any one of claims 1 to 3 wherein said inwardly projecting lip has a cross-sectional shape including a horizontal portion and a depending arcuate portion.

14. A hull construction as set forth in any one of claims 1 to 3 wherein said inwardly projecting lip has a cross-sectional shape selected from the group consisting of a semi-circular shape, a trapezoidal shape, and a rectangular shape.

15. A hull construction as set forth in any one of claims 1 to 3 wherein said well has a water line area of from 3% to 40% of the water line area of said keel.

16. A hull construction as set forth in any one of claims 1 to 3 wherein said well has a water line area of from 8% to 30% of the water line area of said keel.

17. A hull construction as set forth in any one of claims 1 to 3 wherein said well has a water line area of from 15% to 30% of the water line area of said keel.

18. A hull construction as set forth in any one of claims 1 to 3 wherein said well has a water line area of 15% of the water line area of said keel.

19. A hull construction for a seagoing vessel comprising a deck for receiving drilling equipment thereon;

a flat bottomed keel below said deck;

a pluralty of wells at a mid-section of said deck, each well extending vertically from and between said deck and said keel for an inward and outward flow of seawater from below; and at least one inwardly projecting lip in at least one of said wells forming a constricted opening in said one well to delay said inward and outward flow of seawater in said one well to improve the inertial resistance of the hull construction against heaving motions.

20. A hull construction as set forth in claim 19 which further comprises means in a peripheral wall of said one well to define a chamber for an inflow and outflow of seawater from said one well.

21. A hull construction as set forth in claim 20 wherein said means comprises at least one perforated plate disposed in spaced relation to a wall of said one well and extending upwardly from said lip to define said chamber therebetween.

22. A hull construction as set forth in claim 21 wherein said plate has circular perforations constituting from 10% to 30% of the total area of said plate and said plate is spaced from a wall of said one well a distance of from 1 to 5 meters.

23. A hull construction as set forth in claim 19 which further comprises at least one outwardly directed lip on an outer side of said keel extending from the bow towards the stem and below the water line thereof.

24. A hull construction as set forth in claim 19 wherein said wells have a water line area of from 8% to 30% of the water line area of said keel.

* * * * *

UNITED STATES PATENT AND TRADEMARK OFFICE

CERTIFICATE OF CORRECTION

PATENT NO. : 6,220,194 B1
DATED : April 24, 2001
INVENTOR(S) : Geir Kjersem

It is certified that error appears in the above-identified patent and that said Letters Patent is hereby corrected as shown below:

Column 2,
Line 11, change `It' to -- If --

Column 5,
Line 9, change `nor' to -- not --

Column 7,
Line 20, cancel `a'
Line 38, change `shit' to -- ship --

Column 9,
Line 35, after `to be' insert -- operated --

Signed and Sealed this

Twenty-third Day of October, 2001

*Attest:*

Nicholas P. Godici

*Attesting Officer*

NICHOLAS P. GODICI
*Acting Director of the United States Patent and Trademark Office*